US011215088B2

(12) United States Patent
Biermann et al.

(10) Patent No.: US 11,215,088 B2
(45) Date of Patent: Jan. 4, 2022

(54) MODULE FOR A VARIABLE-LIFT VALVE DRIVE OF AN INTERNAL COMBUSTION ENGINE

(71) Applicant: Schaeffler Technologies AG & Co. KG, Herzogenaurach (DE)

(72) Inventors: Andreas Biermann, Fürth (DE); Benedikt Noe, Nuremberg (DE); Martin Steigerwald, Herzogenaurach (DE); Michael Pribek, Uehlfeld (DE); Frank Himsel, Obermichelbach (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 17/258,909

(22) PCT Filed: Jun. 11, 2019

(86) PCT No.: PCT/DE2019/100534
§ 371 (c)(1),
(2) Date: Jan. 8, 2021

(87) PCT Pub. No.: WO2020/015776
PCT Pub. Date: Jan. 23, 2020

(65) Prior Publication Data

US 2021/0324767 A1 Oct. 21, 2021

(30) Foreign Application Priority Data

Jul. 17, 2018 (DE) ..... 10 2018 117 234.6

(51) Int. Cl.
*F01L 1/18* (2006.01)
*F01L 1/22* (2006.01)

(52) U.S. Cl.
CPC *F01L 1/18* (2013.01); *F01L 1/22* (2013.01); *F01L 2001/186* (2013.01)

(58) Field of Classification Search
CPC ... F01L 1/185; F01L 2001/186; F01L 1/2405; F01L 1/46; F01L 13/0005; F01L 2013/101; F01L 2820/031
(Continued)

(56) References Cited

U.S. PATENT DOCUMENTS 4,221,201 A * 9/1980 Soeters, Jr. ..... F02D 13/06 123/90.16
4,259,931 A * 4/1981 Clark ..... F02D 13/06 123/198 R
(Continued)

FOREIGN PATENT DOCUMENTS

DE 69615329 T2 7/2002
DE 102016220859 A1 9/2017
(Continued)

*Primary Examiner* — Jorge L Leon, Jr.

(57) ABSTRACT

A preassembled module for a variable-lift valve drive of an internal combustion engine is provided for installation into a cylinder head. The module has a base plate with an electric linear actuator which lies on an upper side of the base plate. A guide plate, which lies on the upper side, has an outer side wall arranged to guide a slide piece. The guide piece extends below the base plate two downwardly pointing actuating fingers. Each respective actuating finger has a contact surface for moving a transverse coupling slide of a switchable rocker arm. The slide piece has a bracket which protrudes over the guide plate with a contact landing arm which runs transversely relative to the electric linear actuator. An actuator-side end of the contact landing arm is in contact with an actuating pin of the electric linear actuator to move the slide piece.

19 Claims, 4 Drawing Sheets

(58) Field of Classification Search
USPC ..... 123/90.41, 90.43
See application file for complete search history.

(56) References Cited

U.S. PATENT DOCUMENTS

| | | | | |
|---|---|---|---|---|
| 2011/0126786 | A1* | 6/2011 | Kidooka | F01L 1/053 123/90.16 |
| 2020/0131953 | A1* | 4/2020 | Cecur | F01L 1/185 |

FOREIGN PATENT DOCUMENTS

| | | | |
|---|---|---|---|
| DE | 102016212365 | A1 | 1/2018 |
| DE | 102017101792 | A1 | 8/2018 |
| FR | 2990465 | A1 | 11/2013 |
| JP | 2016011664 | A | 1/2016 |

* cited by examiner

MODULE FOR A VARIABLE-LIFT VALVE DRIVE OF AN INTERNAL COMBUSTION ENGINE

CROSS-REFERENCE TO RELATED APPLICATIONS

This application is the U.S. National Phase of PCT Application No. PCT/DE2019/100534 filed on Jun. 11, 2019 which claims priority to DE 10 2018 117 234.6 filed on Jul. 17, 2018, the entire disclosures of which are incorporated by reference herein.

TECHNICAL FIELD

This disclosure relates to a module for a variable-lift valve drive of an internal combustion engine.

BACKGROUND

Such a module with an actuator-loaded push rod and actuating fingers is now also referred to as an electronic rocker module. An example of this can be found in DE 10 2017 101 792. A row of exhaust valves of a 3-cylinder internal combustion engine is assigned a common push rod with an electric actuator on the end face in the cylinder head. Two gas exchange valves with the same effect are provided for each cylinder. When the actuator is not energized, the push rod is reset via the force of a compression spring arranged near the actuator.

The components of the above-mentioned "long" module must be laboriously mounted on the cylinder head and specially prepared for the respective type of internal combustion engine. For this purpose, the cylinder head has slots for guiding the push rod in the section of the camshaft bearing, through which the comparatively long, filigree push rod, which is difficult to handle, must be guided during assembly; with subsequent assembly of the actuating fingers thereon. The electric actuator is aligned behind the push rod and unnecessarily increases the installation space of the internal combustion engine; in addition, it must be fastened separately.

It is also established that a simultaneous actuation of the series of gas exchange valves has a high power requirement and can only perform for a short time window. In addition, a comparatively strong restoring spring means must be installed. It is completely clear that internal combustion engines with a number of cylinders >3 are also possible.

SUMMARY

The object is to create a module that is easy to assemble and can be used in a variety of ways.

According to the disclosure, this object is achieved by the novel features described herein.

Accordingly, it is a matter of an "externally" preassembled module for installation in a cylinder head of the internal combustion engine. The module has a base with a guide plate standing vertically thereon, on which base plate lies the electric linear actuator with a slide piece guided parallel to the electric actuator with only one or two actuating fingers running on one side wall of the guide plate, which slide piece or at least the actuating fingers thereof extend under the base plate. The slide piece is connected to a bracket that protrudes over the guide plate and has a contact landing arm running transversely to the electric linear actuator, the actuator-side face of which is in contact with an actuating pin of the electric linear actuator for moving the slide piece in one direction. The restoring spring means of the module is at least indirectly clamped between the slide piece and the base plate.

Thus, a module without the above-mentioned disadvantages is provided. The now short module for the actuation of 1 or 2 switchable rocker arms (outlet or inlet row) of only one cylinder of the internal combustion engine (having three switchable rocker arms with three equally acting gas exchange valves of the cylinder is also conceivable) can be supplied in a completely externally preassembled state to the internal combustion engine and assembled there "from above" in an automated manner or by hand. The transport and handling thereof are comparatively easy. The person skilled in the art will recognize that this module can now be used universally over a wide range of internal combustion engine types. It is also possible to only equip a cylinder head with the modules to a partial extent. It is also clear that the individual module only has a comparatively low energy requirement with a sufficiently large switching time window.

According to an expedient development of the disclosure, a retaining wall can protrude orthogonally from the guide plate, potentially in one piece, on the rear side of which the electric linear actuator is held via a flange piece extending from the front side thereof. It is clear here that the electric linear actuator can also be attached directly to the base plate.

In an example embodiment, a supporting wall projects away from the retaining wall, facing the guide plate, also possibly connected in one piece. The design thus has an extremely rigid structure. The above-mentioned elements can be combined in one component and manufactured from sheet steel using stamping and bending technology. At least one of these wall pieces of the U-profile can also be bent up in one piece from the base plate, which can be made of sheet steel. Otherwise, joining techniques such as welding or screwing are available for fastening the U-profile to the base plate, provided that suitable fastening angles are used for screwing.

In an example embodiment, the base plate is shown with two simple longitudinal segments or strips, between the ends of which the electric linear actuator is located. To fasten the base plate to the cylinder head, the longitudinal strips have holes, for example, at the ends thereof. In this way, these can be screwed to be parallel to the camshaft or to the longitudinal wall of the internal combustion engine, at suitable contact points on the cylinder head, such as camshaft bearing shells or components close thereto.

It is also provided to integrate the restoring spring means for the slide piece in the module. For this purpose, at least one simple helical compression spring is provided, which is clamped between the contact landing arm and a collar of a support stem, which support stem is encompassed by the helical compression spring and stands at least indirectly on the front side of the retaining wall. Alternatively, an electromagnetic or other resetting can also take place via a servo means.

An "internal" guidance of the guide plate with dependent actuating fingers on the module is provided. Accordingly, in simple terms, a linear guide is provided in the actuator direction, facilitated by a longitudinal slot arranged in the slide piece. According to a first sub-variant of the disclosure, a sliding plate extending from the guide plate is guided in this longitudinal slot. According to a second sub-variant, sliding pins can protrude from the guide plate, which are guided in the longitudinal slot and, therebehind, rest against an outer wall of the slide piece via a ring head. Alternatively, the sliding plate or the sliding pins can also extend from the retaining plate or the longitudinal slot can lie in the guide plate, for example.

The flexible actuating fingers made of spring steel can be present as components that are joined separately to the slide piece. The idea here is to simply suspend them from the slide piece by means of offsets or the like made thereon. However, it is also conceivable and intended to design the actuating fingers, if necessary, as a one-piece component of the slide piece.

The respective actuating finger has a twisted geometry and is thus skillfully guided to the respective switchable rocker arm in the narrow cylinder head area.

Alternatively, a hydraulic or pneumatic actuator can be used instead of the electric actuator. It is also clear that, if necessary, the slide piece can be reset via the electric actuator or the final control element.

DETAILED DESCRIPTION OF THE EMBODIMENTS

A short module 1 for a variable-lift valve drive of an internal combustion engine is shown.

The module 1 with all the components described below is supplied in a preassembled state to a cylinder head of the internal combustion engine and screwed thereonto.

Figure 1:
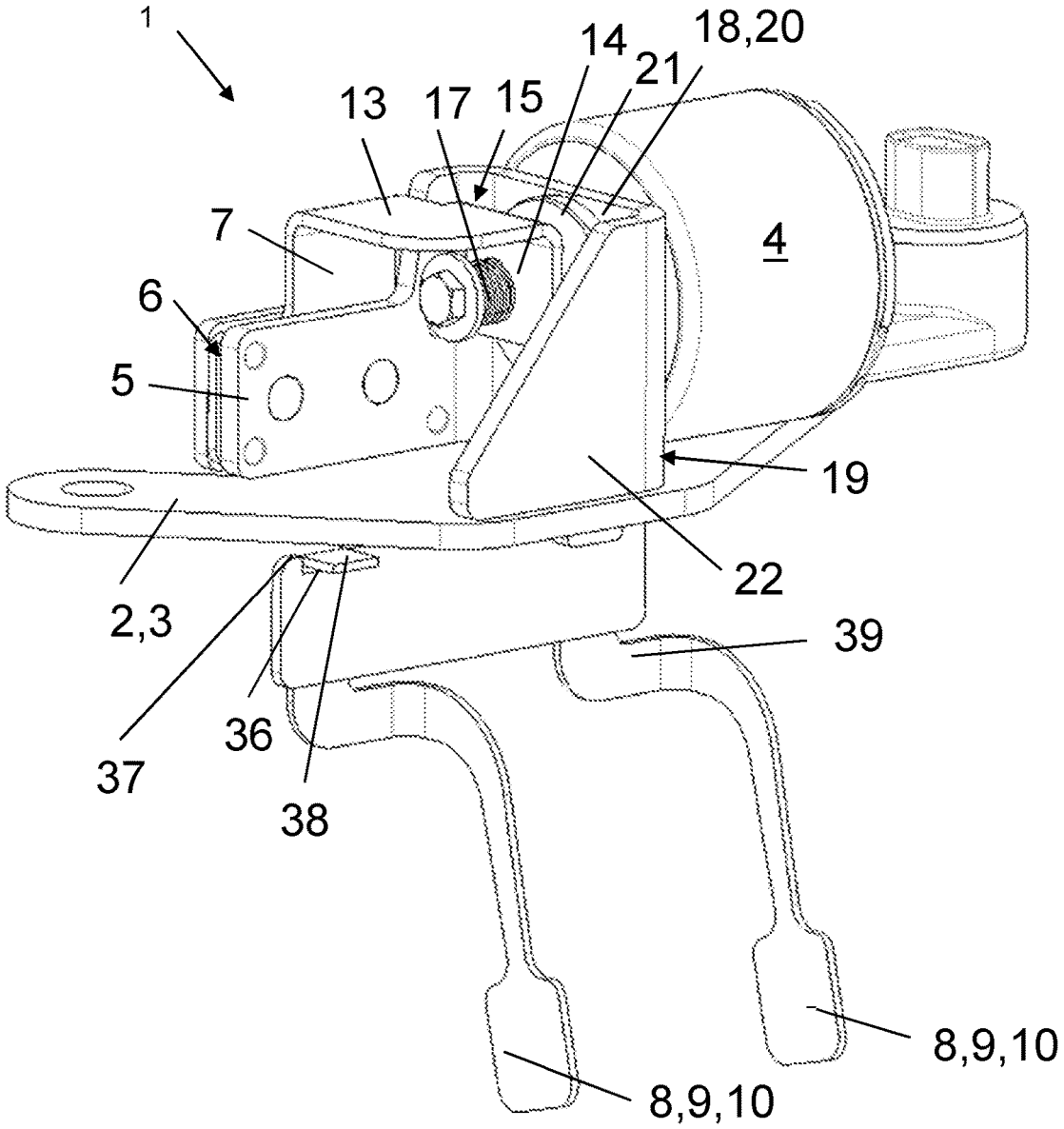
FIG. 1 shows a spatial front view of the module.
Figure 2:
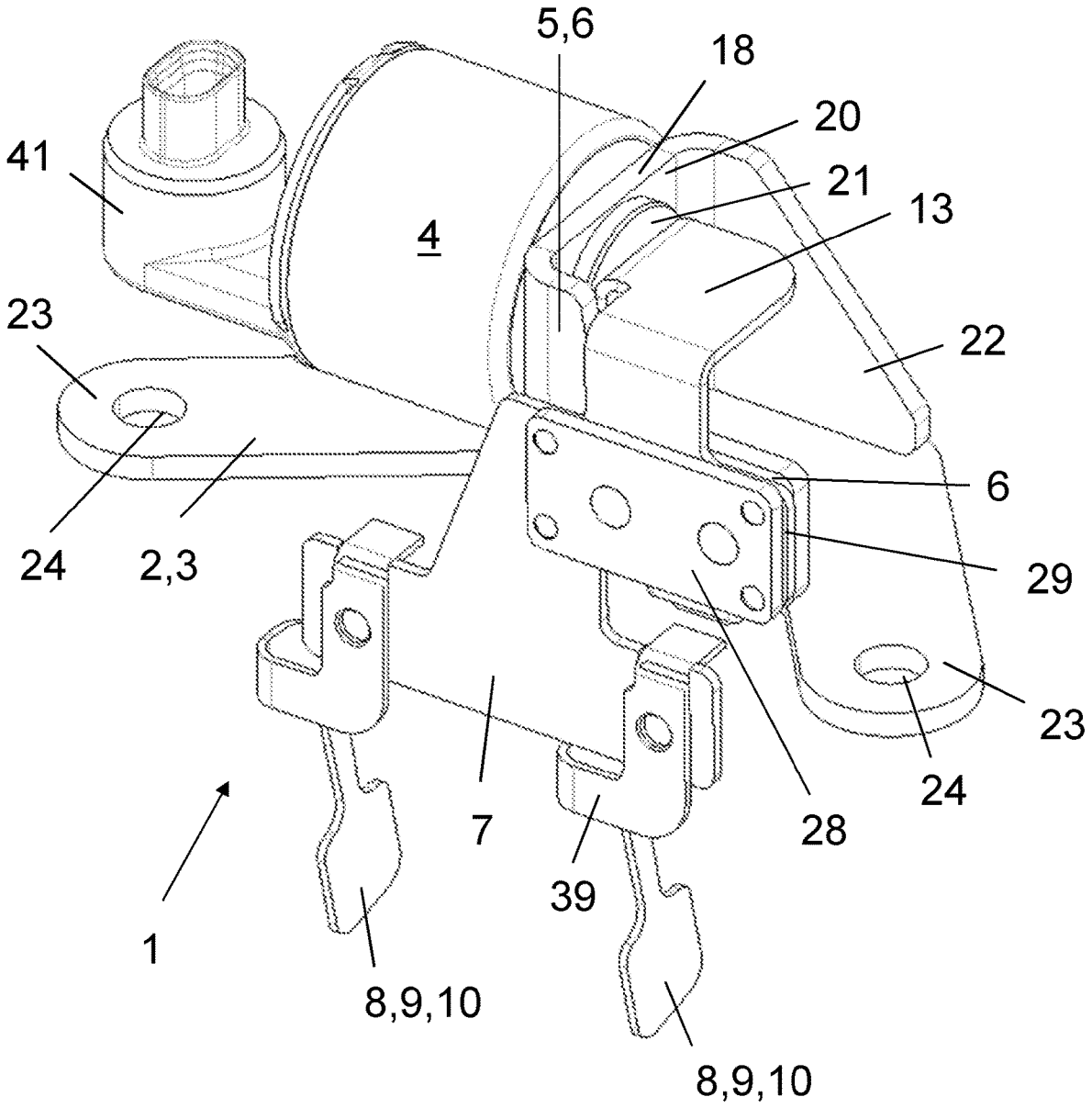
FIG. 2 shows a spatial rear view of the module.

The module 1 has a base plate 2 made of sheet steel, consisting of two strips running towards one another (see in particular FIGS. 1, 2). An electric linear actuator 4 is located on an upper side of the base plate 2, the electrical connection (plug 41) of which is angled upwards, which saves installation space in the longitudinal direction of the module.

On the upper side 3 of the base plate 2, in front of the electric linear actuator 4, there is a fixed guide plate 5, also made of sheet steel, which extends in the longitudinal direction of the actuator. On the actuator side, a retaining wall 18 is bent orthogonally from the guide plate 5, which can also be joined thereto, from which a supporting wall 22 in turn protrudes in one piece. This assembly 18, 5, 22 thus has a U-like cross section. On a rear side 19 of the retaining wall 18, the electric linear actuator 4 is joined via a flange piece 21 extending from a front side 20 of the retaining wall 18 and penetrating same. It is clear that the electric linear actuator can also be screwed onto the retaining wall 18.

Figure 5:
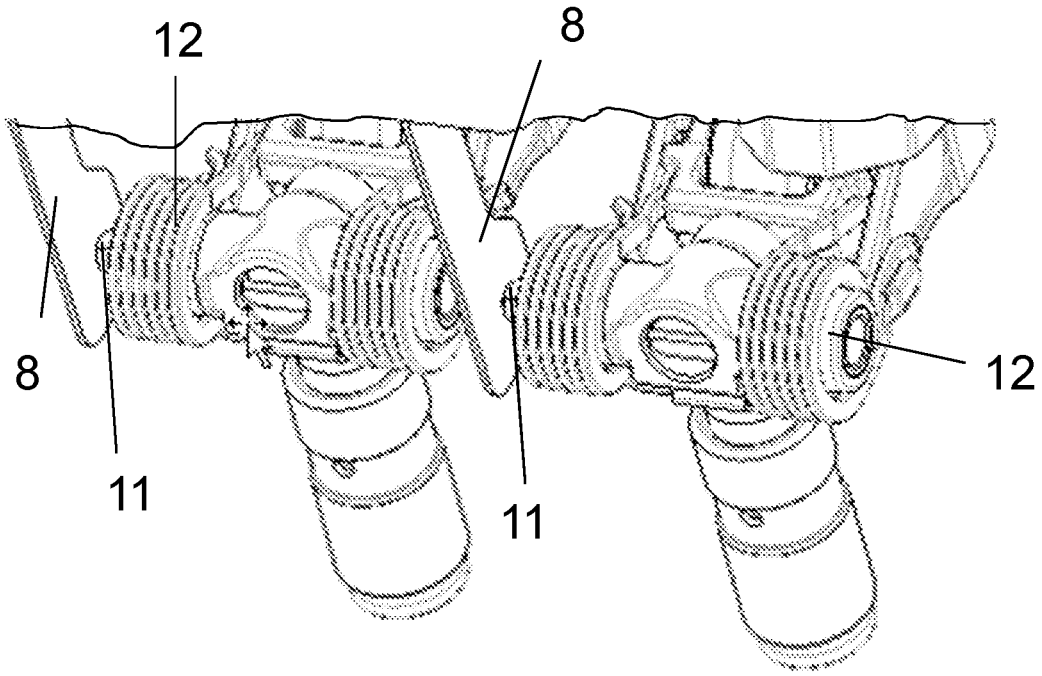
FIG. 5 shows a partial view of the cylinder head with actuated rocker arms.

On an outer side wall 6 of the guide plate 5, a slide piece 7 made of sheet steel runs longitudinally movably thereon, from which two actuating fingers 8 made of spring steel are suspended to below the base plate 2. Each actuating finger 8 (see also FIG. 5) at the free end 9 thereof has a contact surface 10 for displacing a transverse coupling slide 11 of a switchable rocker arm 12. As described in more detail in FIG. 1, the respective actuating finger 8 is a multi-part component of the slide piece 7. It is seated via an offset 38 in a pocket 36 of a transverse web 37 of the slide piece 7.

To move the slide piece 7 in one direction (to the left according to FIG. 1), the slide piece has a one-piece connected bracket 13 projecting over the guide plate 5 and a contact landing arm 14 running transversely to the electric linear actuator 4. The actuator-side face 15 thereof is contacted by an actuating pin 16 (see also FIG. 6) of the electric linear actuator 4, which actuating pin 16 extends centrally through the flange piece 21.

The above-mentioned displacement of the slide piece 7 takes place, more precisely, in a slot 29 lying between the outer side wall 6 of the guide plate 5 and a retaining plate 28 firmly connected to the latter via a linear guide 30 thus formed.

Figure 3:
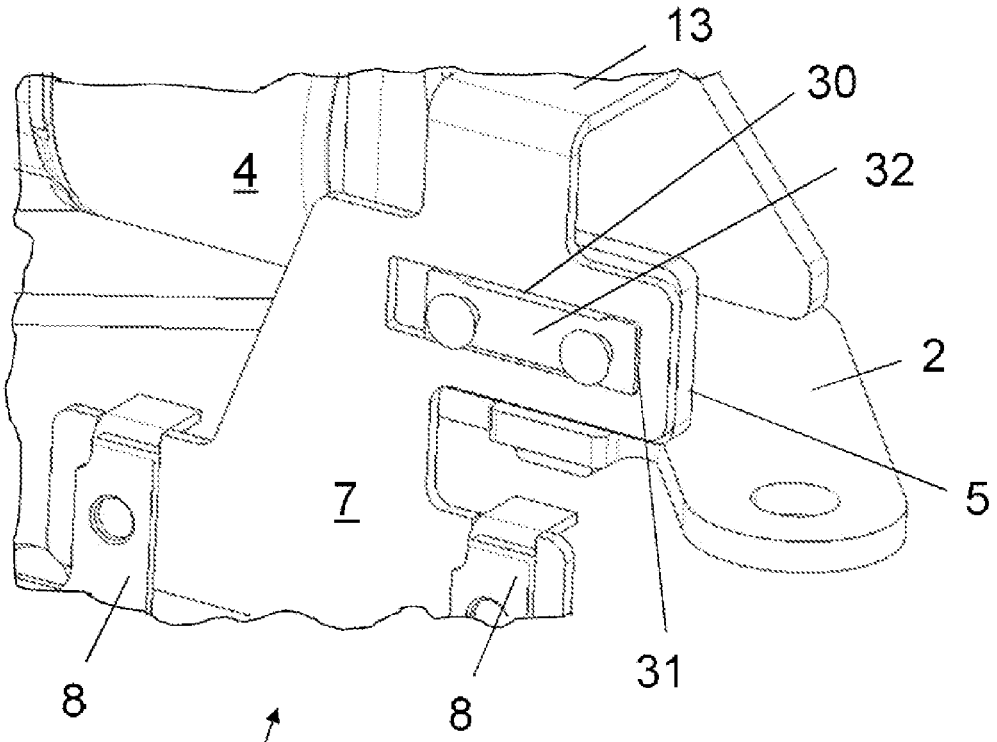
FIG. 3 shows the rear view according to FIG. 2 in partial section with a first variant of the linear guide.

According to the link-like solution according to FIG. 3, wherein the associated retaining plate 28 is clearly visible from FIG. 2, the slide piece 7 has a longitudinal slot 31. In this, a sliding plate 32 extending from the guide plate 5 is guided in a link-like manner, which is firmly connected to the guide plate 5.

Figure 4:
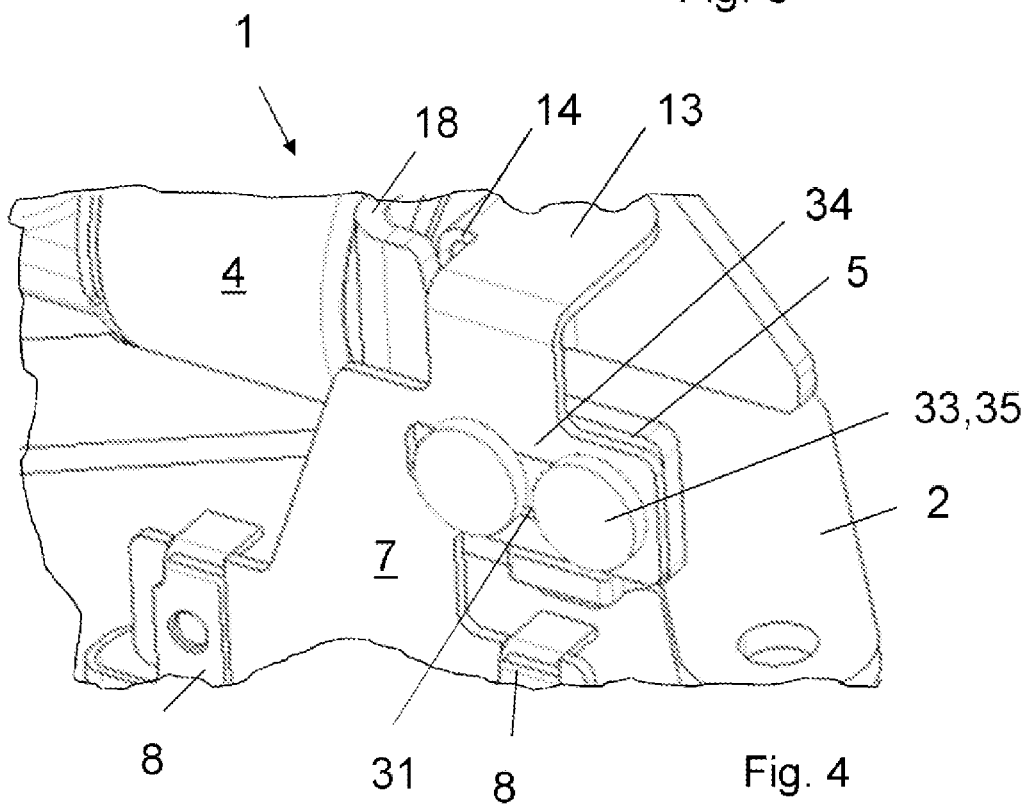
FIG. 4 shows the rear view according to FIG. 2 in partial section with a second variant of the linear guide.

The alternative shown in FIG. 4 shows two sliding pins 33 protruding from the guide plate 5, which are guided in the above-mentioned longitudinal slot 31 and bear against a free outer wall 34 of the slide piece 7 via the respective ring head 35 thereof. With this solution, the retaining plate 28 can be omitted.

Figure 6:
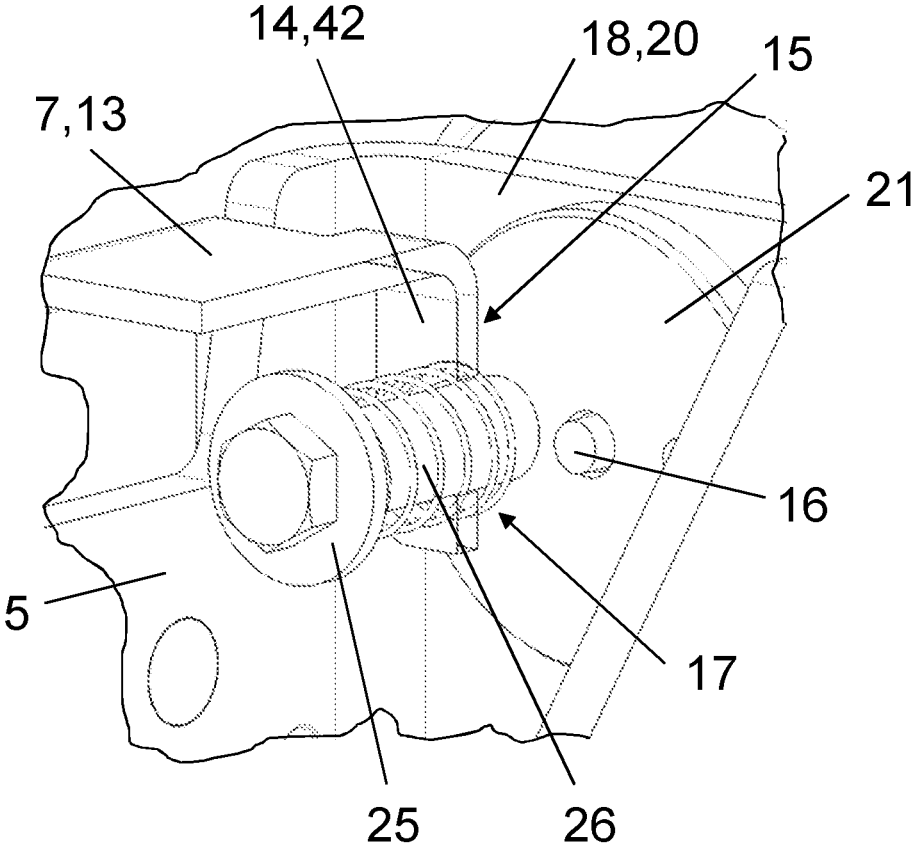
FIG. 6 shows a detail of the reset mechanism.

While the current supply to the electric linear actuator 4 is switched off or greatly reduced at the same time, a return displacement of the slide piece 7 takes place via a restoring spring means 17, which can be seen clearly from FIG. 6. A helical compression spring is applied for this purpose. This comprises a support stem 26, which penetrates the contact landing arm 14 of the guide plate 5 and here stands on a head of the flange piece 21 on the front side 20 of the retaining wall 18. At one end, the helical compression spring acts against a front side 42 of the contact landing arm 14, which is connected to the slide piece 7 via the bracket 13. At the other end, it acts against a collar 25 of the support stem 26 remote from the actuator.

A power supply to the actuator 4, for example at the beginning of a predetermined coupling time window for the transverse coupling slides 11 of the two rocker arms 12, leads to the extension of the actuating pin 16 thereof "forward" to the contact landing arm 14, provided that the actuating pin 16 is not already there before when no power is supplied. As a result, the slide piece 7 with dependent actuating fingers 8 ultimately performs a translational movement thereon (according to FIG. 1 to the left, according to FIGS. 3, 4 to the right). Assuming a basic cam cycle, the actuating fingers 8 move the transverse coupling slides 11 of the rocker arms 12, whereby, depending on the configuration, either a coupling or a decoupling of the two lever parts of the rocker arm 12 is achieved, which need not be described in more detail at this point.

LIST OF REFERENCE SYMBOLS

1 Module
2 Base plate
3 Upper side
4 Electric linear actuator, actuator
5 Guide plate
6 Side wall
7 Slide piece
8 Actuating finger
9 Free end
10 Contact surface
11 Transverse coupling slide

12 Rocker arm
13 Bracket
14 Contact landing arm
15 End
16 Actuating pin
17 Restoring spring means
18 Retaining wall
19 Rear side
20 Front side
21 Flange piece
22 Supporting wall
23 Free end
24 Bore
25 Collar
26 Support stem
27 Not assigned
28 Retaining plate
29 Slot
30 Linear guide
31 Longitudinal slot
32 Sliding plate
33 Sliding pin
34 Outer wall
35 Ring head
36 Pocket
37 Transverse web
38 Offset
39 Extension
40 Support element
41 Plug
42 Front side

The invention claimed is:

1. A preassembled module for a variable-lift valve drive of an internal combustion engine, the preassembled module comprising:

a base plate configured for fastening the preassembled module to the internal combustion engine;

an electric linear actuator arranged above the base plate; and, a guide plate fixed to an upper side of the base plate, the guide plate including an outer side wall configured to guide a slide piece, the slide piece extending below the base plate and including two downwardly extending actuating fingers, each actuating finger including a free end with a contact surface configured for moving a transverse coupling slide of a corresponding switchable rocker arm;

wherein the slide piece further includes a bracket extending over the guide plate, the bracket extending transversely to an actuating pathway of an actuating pin of the electric linear actuator, the actuating pin configured to be actuated in a first direction by the electric linear actuator; and, wherein a restoring spring is configured to bias the slide piece in a second direction, opposite the first direction.

2. The preassembled module of claim 1, wherein the guide plate further includes a retaining wall extending transversely to the actuating pathway, a rear side of the retaining wall joining the electric linear actuator via a flange piece projecting out from a front side of the retaining wall.

3. The preassembled module of claim 2, wherein a supporting wall opposite and parallel to the guide plate protrudes from the retaining wall, and wherein the supporting wall, guide plate, and retaining wall are constructed from one piece so as to form a U-shaped profile.

4. The preassembled module of claim 2, wherein the restoring spring includes at least one helical compression spring, a first end of the at least one helical compression spring acts on a front side of the bracket, and a second end of the at least one helical compression spring acts against a collar arranged at an end of a support stem, the support stem extending from the front side of the retaining wall.

5. The preassembled module of claim 1, wherein at least one of the base plate and the slide piece is formed from sheet steel via stamping and bending.

6. The preassembled module of claim 1, wherein the base plate is formed from two longitudinal segments extending towards each another, and a bore is arranged at a free end of each longitudinal segment so as to connect the preassembled module to a cylinder head of the internal combustion engine.

7. The preassembled module of claim 1, wherein the slide piece is configured to move within a slot formed between the outer side wall of the guide plate and a retaining plate.

8. The preassembled module of claim 7, wherein the slide piece further includes a longitudinal slot configured to guide one of: a) a sliding plate extending from the guide plate, orb) at least one sliding pin projecting from the guide plate, the at least one sliding pin slidably engaging a free outer wall of the slide piece via a respective ring head.

9. The preassembled module of claim 1, wherein an offset of each actuating finger is seated in a respective pocket of the slide piece.

10. The preassembled module of claim 1, wherein each actuating finger is a spring steel component extending below the slide piece, each actuating finger further including a first angled extension arranged parallel to the slide piece such that the free end extends from the first angled extension.

11. The preassembled module of claim 1, wherein one of the two downwardly extending actuating fingers is configured to extend between a first longitudinal side of a first switchable rocker arm and a second longitudinal side of a second switchable rocker arm.

12. A preassembled module for a variable-lift valve drive of an internal combustion engine, the preassembled module comprising:

a base plate configured for fastening the preassembled module to the internal combustion engine;

a guide plate fixed to an upper side of the base plate; and, a slide piece configured to be slidably guided along a first pathway defined by: i) an outer wall of the guide plate, and ii) a first longitudinal slot arranged in the slide piece or the guide plate;

wherein the slide piece includes an upper portion extending above the base plate, and a lower portion extending below the base plate, the lower portion including two downwardly extending actuating fingers configured to move together with the slide piece, each actuating finger including a free end with a contact surface configured for moving a transverse coupling slide of a corresponding switchable rocker arm along a second pathway;

wherein an actuator is arranged above the base plate, the actuator including an actuator pin configured to move the slide piece along the first pathway via actuation of the upper portion of the slide piece, the actuator pin configured to move along a third pathway; and, wherein the first, second, and third pathways are parallel to each other.

13. The preassembled module of claim 12, wherein the first longitudinal slot is arranged in the slide piece.

14. The preassembled module of claim 12, further comprising a retaining plate fixed to the guide plate, wherein the retaining plate and the guide plate define a second slot configured to receive and slidably guide the upper portion of the slide piece such that the upper portion extends through the second slot.

15. The preassembled module of claim 12, further comprising a sliding pin extending through the first longitudinal slot, the sliding pin including a ring head configured to slidably guide the slide piece along the first pathway.

16. The preassembled module of claim 12, wherein the contact surface of each actuating finger is arranged transversely to the first, second, and third pathways.

17. The preassembled module of claim 12, further comprising a restoring spring arranged on a support stem, the support stem extending from the guide plate and through the slide piece.

18. The preassembled module of claim 12, wherein one of the two downwardly extending actuating fingers is configured to extend between a first longitudinal side of a first switchable rocker arm and a second longitudinal side of a second switchable rocker arm.

19. A preassembled module for a variable-lift valve drive of an internal combustion engine, the preassembled module comprising:

a base plate configured for fastening the preassembled module to the internal combustion engine;

a guide plate fixed to an upper side of the base plate; and, a slide piece configured to be slidably guided along a first pathway defined by: i) an outer wall of the guide plate, and ii) a first longitudinal slot arranged in the slide piece or the guide plate;

wherein the slide piece includes an upper portion extending above the base plate, and a lower portion extending below the base plate, the upper portion including a contact landing arm arranged transversely to the first pathway, and the lower portion including two downwardly extending actuating fingers configured to move together with the slide piece and contact landing arm, each actuating finger including a free end with a contact surface configured for moving a transverse coupling slide of a corresponding switchable rocker arm along a second pathway;

wherein an actuator is arranged above the base plate, the actuator including an actuator pin configured to move the slide piece along the first pathway via actuation of the contact landing arm, the actuator pin configured to move along a third pathway;

wherein the first, second, and third pathways are parallel to each other; and, wherein the slide piece and contact landing arm are constructed from one piece.

* * * * *